United States Patent [19]

Rookus

[11] 4,299,063

[45] Nov. 10, 1981

[54] SHARPENER FOR SCREENS OF CIRCULAR BLADES

[76] Inventor: James Rookus, 2902 Marshall, S.E., Grand Rapids, Mich. 49508

[21] Appl. No.: 57,217

[22] Filed: Jul. 13, 1979

[51] Int. Cl.[3] ..... B24B 3/48; B26B 19/48

[52] U.S. Cl. ..... 51/241 S; 76/DIG. 9

[58] Field of Search ..... 51/241 R, 241 S, 246; 30/35, 37, 38, 43.92, 138; 76/82, DIG. 9

[56] References Cited

U.S. PATENT DOCUMENTS

| | | | |
|---|---|---|---|
| 2,953,851 | 9/1960 | Wheeler | 51/241 R |
| 3,163,964 | 1/1965 | Wheeler | 30/37 |
| 3,935,638 | 2/1976 | Rookus | 30/37 |

*Primary Examiner*—Roscoe V. Parker

*Attorney, Agent, or Firm*—Price, Heneveld, Huizenga & Cooper

[57] ABSTRACT

A device is disclosed for sharpening both the blade and the screen of a circular blade type electric shaver. A cup is provided which seats in the well from which the screen and blade have been removed. The blade is seated in the cup and engaged to the drive post or shaft of the shaver. By driving the blade from the motor of the shaver while an abrasive surface is held against the blade its cutting edges are sharpened. To hone the inside of the screen a rotor is placed in the cup. The top of the rotor has an abrasive surface. When a screen is pressed against the abrasive surface and the rotor is driven by the shaver motor, the inside surface of the screen is honed.

5 Claims, 8 Drawing Figures

SHARPENER FOR SCREENS OF CIRCULAR BLADES

BACKGROUND OF THE INVENTION

The invention relates to a device for improving the functional characteristics of electric shavers of the type having a circular blade which effects its cutting by rotating in contact with a circular screen. These blades become dull as a result of repeated use. When dull they not only provide a slow and poor shave but they tend to leave a relatively high stubble. In my U.S. Pat. No. 3,935,638, entitled SHARPENER FOR ELECTRIC SHAVERS, issued Feb. 3, 1976, I disclosed a means for sharpening rotary blades which utilizes the shaver motor as the means for powering the blade while in contact with an abrasive surface. The sharpening device disclosed in that patent has proven to be effective in sharpening the blade and thus materially improving the shaving quality of this type of electric shaver.

However, I have discovered that to make this type of electric shaver a truly effective shaving instrument it is necessary to sharpen both the blade and the screen against which the blade operates. By sharpening both the screen and the blade it has been found that the functional characteristics of the electric shaver are materially improved and can be maintained in improved condition. In fact, an electric shaver which has been conditioned by this invention is capable of delivering a shave which is of the quality and closeness of the best safety razor.

BRIEF DESCRIPTION OF THE INVENTION

The invention provides a cup to seat in the opening in the shaver head which remains after the screen and the blade have been removed. The cup has a shoulder to limit its telescoping movement into the head and a central opening through which the shaft normally used to drive the blade projects up into the cup. After the cup has been seated in the shaver head, the blade is placed within the cup and engaged with the shaft. The lower part of the cup is of a size such that the blade fits closely within it. To sharpen the blade, a disk-like insert is provided which is seated within the upper or open part of the cup. This disk has an abrasive surface engaging the blade and, by operating the shaver motor, the blade is rotated and honed against the abrasive surface. The disk has a handle to provide a convenient grip for the user.

To sharpen the screen, the disk and blade are removed and an annular rotor is seated within the cup. The rotor has an opening such that it engages the shaft and its upper or free end has an annular abrasive surface. The size of this annulus of abrasive is such as to just fit within the inside of the screen in the area where it is in contact with the blade. Again, by operating the shaver motor, the rotor is powered and hones the inside of the screen so that it, along with the blade, is sharp and a positive cutting action results.

DESCRIPTION OF THE PREFERRED EMBODIMENT

Figure 1:
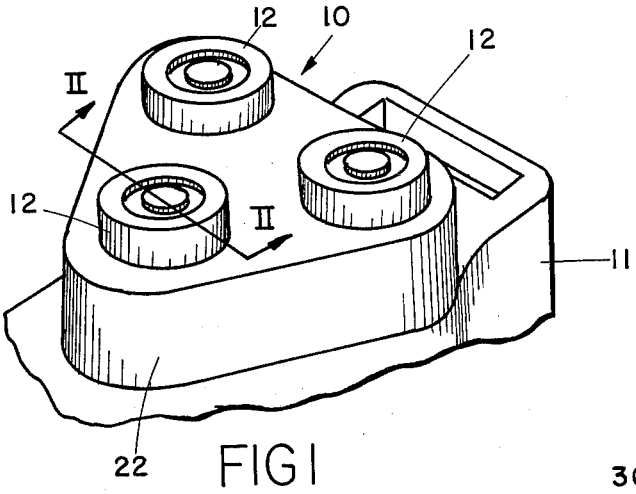
FIG. 1 is a fragmentary, oblique view of the head of a typical rotary blade, electric shaver.

The numeral 10 indicates the head of a shaver having a body 11 containing a motor. The head has three individual shaver units 12 driven by the motor. Each of the shaver units 12 has a circular screen 13. The screen 13 has an annular internal channel 14 and a surrounding skirt portion 15 terminating in an outwardly directed flange 16. Seated within the screen is a blade 17 which consists of a plurality of arms each of which terminates in a cutter element 18. The center of the blade has a slot which seats over the key 19 at the end of the shaft 20. The screen 13 is seated in a well 21 in the cover 22 of the shaver head. The flange 16 which surrounds the screen seats under the walls 23 of the well 21 limiting the outward movement of the screen. The shaft 20 is resiliently biased outwardly forcing the blade 17 against the screen, thus, holding the screen firmly against the cover 22. The annular channel 14 is of a radial width to seat the cutters 18. The shaft is rotated by a motor mounted in the body 11 of the shaver in a manner well known in the electric shaver art.

All of the preceding structure is conventional.

Figure 3:
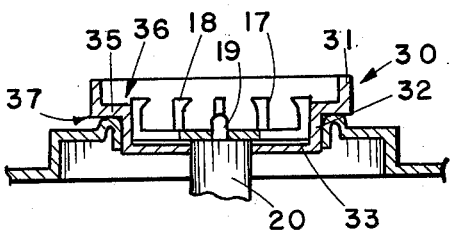
FIG. 3 is a view similar to FIG. 2 illustrating the cup used in this invention installed with the blade seated within it.
Figure 5:
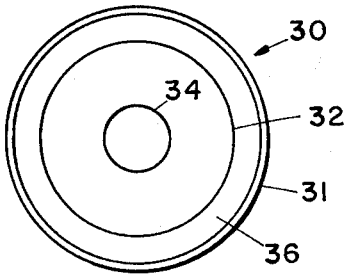
FIG. 5 is a view of the open end of the cup used for sharpening either the blade or the screen.

When it is desired to sharpen either the blade 17 or the screen 13 the cover 22 is removed from the shaver and the screen and blade to be sharpened are also removed. The cover is then replaced and a cup 30 is seated within the well 21 as shown in FIG. 3. The cup 30 is circular and has an outer open ended portion 31 and an inner portion 32 partially closed at the lower end by a bottom 33. The bottom 33 has a central opening 34 of a size such that the shaft 20 can pass through it without engaging the cup. The inner or lower portion of the cup 32 has an inside diameter such that it fits closely about the blade 17 but does not interfere with the blade's free rotation when the device is operated. The outside diameter of the cup 30 is such as to snuggly and firmly fit telescopically within the well 21 of the cover 22.

The outer portion 31 of the cup is of greater diameter than the inner portion and the inner and outer portions are joined by a radially extending flange 35 which forms an upwardly facing shoulder 36 on the inside of the cup and a downwardly facing stop surface 37 on the outside of the cup. The stop surface 37 limits the inward movement of the cup when it is inserted into the well 21.

Figure 4:
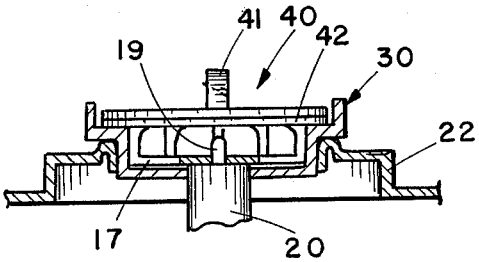
FIG. 4 is a view similar to FIG. 3 illustrating the invention as it appears when the blade is being sharpened.
Figure 6:
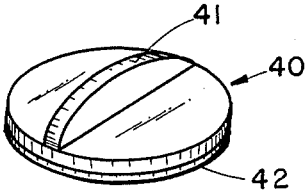
FIG. 6 is an oblique view of the disk used for sharpening the blade.

A disk-like cap 40 is provided having a diameter such that it closely fits within the outer open portion 31 of the cup (FIG. 4). The disk or cap 40 preferably has a grip or handle 41 projecting from one face and is equipped with a layer of abrasive 42 on the opposite face. While this abrasive is illustrated as being a continuous surface covering the entire inner face of the cap 40, it need only be an annulus having a radial width such that it contacts the cutters 18 of the blade 17. To sharpen the blade while it is seated in the cup 30 the disk 40 is pressed into the open end of the cup and down until it seats on the shoulder 36. In so doing it engages the blade 17 and depresses it down into the lower portion of the cup as indicated in FIG. 4. Preferably, the lower portion of the cup is of such a depth that the blade, when fully depressed, is slightly above the surface of the bottom 33 of the cup. In this manner the blade will be allowed to float slightly and thus maintain a uniform pressure against the abrasive surface throughout the entire circular area of contact between the two. With the blade in contact with the abrasive surface, the motor of the shaver is operated to spin the blade. This results in the blade being sharpened in a matter of something less than a minute of operation.

Figure 7:
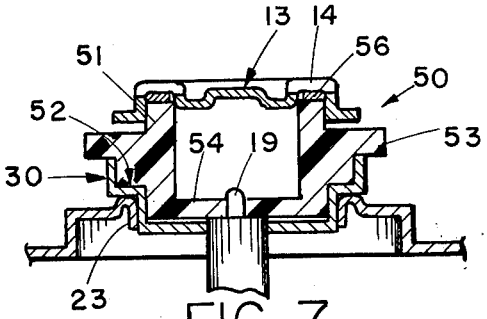
FIG. 7 is a sectional view similar to FIG. 3 illustrating the invention arranged for sharpening the inner surface of the screen.
Figure 2:
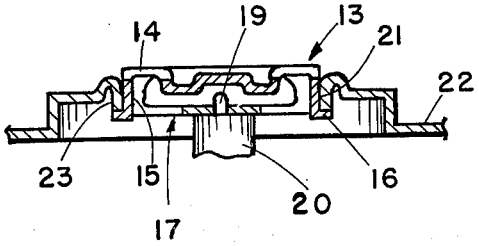
FIG. 2 is a fragmentary, enlarged sectional view taken along the plane II—II of FIG. 1.
Figure 8:
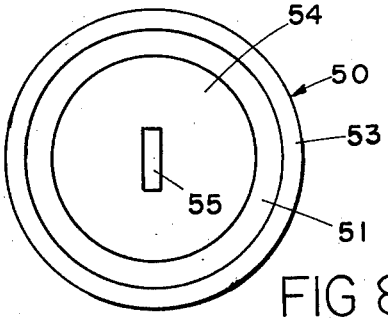
FIG. 8 is a view of the top of the open end of the rotor illustrated in FIG. 7.

Having sharpened the blade, the next step is to sharpen the inside surface of the screen by honing it. To do this, the cap 40 and the blade 17 are removed. These are replaced by a rotor 50 (FIG. 7). The rotor 50 has an upstanding annular sidewall 51 which has a height substantially greater than the depth of the cup 30. The lower end of the rotor 50 has a stepped outside diameter to seat in both the lower and upper portions of the cup 30 and thus has an intermediate, radially extending ledge 52. Externally of the ledge 52, the rotor has a radially extending flange 53 of a diameter greater than the outer diameter of the cup and positioned from the inner end of the rotor a distance such that when the rotor is fully inserted within the cup, this flange rests on the outer end of the cup holding the bottom end 54 of the rotor slightly spaced from the bottom of the cup 30. The bottom wall of the cup has a slotted opening 55 to receive the key 19 of the driven shaft 20 (FIG. 8). Thus, the rotor is driven by the shaft when the latter is powered.

The outer end of the sidewall 51 of the rotor has an annular, abrasive coating or layer 56 which is of a radial width to just fit within the inside of the blade receiving channel 14. To sharpen or hone the inside surface of the screen, the screen is seated over the abrasive surface 56 and pressed down with sufficient firmness to lightly seat the flange 53 on the edge of the cup. Then by operating the shaver motor, the rotation of the rotor will effectively hone the inside surface of the screen while the operator holds the screen stationary.

The invention provides a positive support for the blade while it is being sharpened and further holds the sharpening disk or cap positively positioned with respect to the blade, thus assuring uniform treatment of the cutters of the blade. This is important because it assures not only an effective cutting action by the blade but also it assures a longer life for the blade. However, simply sharpening the blade only sharpens half of what in effect is a two piece cutting machine. By honing the inside surface of the screen, a uniform surface is provided against which the blade can press and rotate. Further, the honing squares the corners where the inside surface of the screen meets the axial channels or openings extending through the screen. As a result of squaring these corners, a sharp, positive, cutting action occurs between the blade and the screen positively assuring an effective and close shave. If these corners are not squared, even a sharp blade is operating against a partially ineffective, cooperating edge and, therefore, cannot produce a positive and uniform cutting action. Because the top of the rotor 50 provides a firm and positive support for the screen, uniformity in the honing action applied to the inside of the screen is assured. The only pressure necessary to effect this is that of the user simply holding the screen on the rotor in much the fashion that one holds a cap over an opening.

It will be seen that the invention provides a complete sharpening kit for this type of electric shaver which consists of only three parts, all of which are relatively light, small and inexpensive. The cup, cap and rotor can all be molded from plastic and the abrasive surface can even be made to be a replaceable unit by providing either the annular replacement for both the blade and screen sharpeners or a simple circular pad to be applied to the inner surface of the cap 40 which can be provided with a peel off adhesive surface. In this case, whenever the abrasive becomes worn or clogged, it may be peeled off and replaced by the user. The lightness and compactness of the equipment is such that it may easily be carried with the razor and thus is suited for travel purposes where it will always be available when needed. Use of the invention both extends the useful life of the screen and the blade as well as insuring a greatly improved and closer shave.

Having described the preferred embodiment of my invention, it will be recognized that various modifications of the invention may be made without departing from the principle of the invention. Such modifications are to be considered as included in the hereinafter appended claims unless these claims by their language expressly state otherwise.

The embodiments of the invention in which an exclusive property or privilege is claimed are defined as follows:

1. In a means for sharpening the screen of an electric shaver of the rotary blade type driven by a rotary shaft, said means comprising a cup having an open upper end, a bottom and circular sides; said bottom having a central opening; said sides intermediate the ends of said cup having a radially outwardly extending offset which forms an external stop surface facing toward said bottom and an internal shoulder facing away from said bottom; a rotor telescopically received within said cup and intermediate its ends having a radially extending flange seated on said shoulder, said rotor having a diameter to closely and rotatably fit within said cup and an annular wall projecting beyond said open end of said cup; an abrasive surface on the projecting end of said wall; a central opening in said bottom of said cup to receive the shaft therethrough and a shaft receiving and engaging opening in said rotor.

2. In a means for sharpening the screen of an electric shaver of the rotary blade type as described in claim 1 wherein said rotor has an outwardly extending shoulder supporting the rotor on the open end of the cup when a screen is pressed against said rotor.

3. In a means for sharpening the screen of an electric shaver of the rotary blade type in which the screen is seated in a circular well of a shaver head and cooperates with a blade driven by a shaft centered in the well, said means comprising: a cup having a bottom and sides adapted to frictionally seat in said well, means on said cup limiting movement of said cup into said well; an opening in said bottom of said cup for receiving said shaft therethrough; a rotor seated in said cup and having an upstanding wall projecting beyond the end of said cup, the end of said wall being of a size to fit closely within the shaver screen; the end of said wall having an abrasive surface for sharpening the inside of the screen when the screen is seated on said surface; said rotor having a bottom; an opening in said bottom, the walls of said opening being shaped to seat closely about and engage said shaft whereby the motion of said shaft is transmitted to said rotor.

4. In a means for sharpening the screen of an electric shaver of the rotary blade type as described in claim 3 wherein said cup has an internally extending shoulder; said rotor having an external radially extending flange seated on said shoulder for holding said rotor perpendicular to said shaft.

5. In a means for sharpening the screen of an electric shaver of the rotary blade type as described in claim 4 wherein said rotor has an external radially extending rim of greater outer diameter than said cup.

* * * * *